US005148759A

United States Patent [19]

Wirth

[11] Patent Number: 5,148,759

[45] Date of Patent: Sep. 22, 1992

[54] THREADING A HOOKED WIRE NEEDLE IN A TIE SEWING MACHINE

[75] Inventor: Rudi Wirth, Schwarzenbach/Wald, Fed. Rep. of Germany

[73] Assignee: LIBA Maschinenfabrik GmbH, Fed. Rep. of Germany

[21] Appl. No.: 573,237

[22] Filed: Aug. 27, 1990

[30] Foreign Application Priority Data

Sep. 1, 1989 [DE] Fed. Rep. of Germany ..... 3929127

[51] Int. Cl.[5] ..... D05B 87/02; D05B 85/08

[52] U.S. Cl. ..... 112/121.22; 112/222; 112/224; 112/225; 223/99

[58] Field of Search ..... 112/83, 93, 222, 224, 112/225, 294, 262.2, 53; 223/99; 66/60 R, 60 H, 62, 78

[56] References Cited

U.S. PATENT DOCUMENTS

| | | | |
|---|---|---|---|
| 1,452,840 | 4/1923 | Meyer | 112/93 |
| 2,286,224 | 6/1942 | Naftali | 112/121.22 X |
| 2,303,380 | 12/1942 | Naftali et al. | 112/121.22 X |
| 2,628,582 | 2/1953 | Martinelli | 112/225 |
| 2,729,372 | 1/1956 | Winter | 112/222 X |
| 2,767,670 | 10/1956 | Surbeck | 112/224 |
| 3,000,334 | 9/1961 | Hedbrandh | 112/121.22 X |
| 3,116,707 | 1/1964 | Newman | 112/222 X |
| 3,508,690 | 4/1970 | Pozzolo | 112/225 X |
| 4,535,709 | 8/1985 | Kühnis et al. | 112/83 |
| 4,974,758 | 12/1990 | Wünsch | 112/222 X |
| 5,071,044 | 12/1991 | Wirth | 112/121.22 X |

FOREIGN PATENT DOCUMENTS

| | | | |
|---|---|---|---|
| 8807418.8 | 9/1988 | Fed. Rep. of Germany . | |
| 0461999 | 7/1975 | U.S.S.R. | 112/294 |
| 2235469 | 3/1991 | United Kingdom | 112/225 |

*Primary Examiner*—Werner H. Schroeder
*Assistant Examiner*—Ismael Izaguirre
*Attorney, Agent, or Firm*—Bell, Seltzer, Park & Gibson

[57] ABSTRACT

An apparatus for threading a needle used in a sewing machine that forms a longitudinal seam in a tie. The needle has an open hook and a shank adjacent its pointed end. A thread gripper movable about two mutually perpendicular axes grips and loops the thread at least partially around the shank of the needle. The thread is received or threaded upon a retracting movement of the needle. In an alternative embodiment, a tined fork loops the thread about the needle.

2 Claims, 5 Drawing Sheets

THREADING A HOOKED WIRE NEEDLE IN A TIE SEWING MACHINE

CROSS-REFERENCES TO RELATED APPLICATIONS

U.S. patent application Ser. No. 07/573,238, now U.S. Pat. No. 5,071,044, and Ser. No. 07/573,834, now U.S. Pat. No. 5,129,342, contain subject matter related to that of the present application.

FIELD OF THE INVENTION

The invention relates to an apparatus for threading a sewing thread in the needle of a machine e.g. for sewing a longitudinal seam along a necktie or similar elongate tubular article. For convenience, the following description is made with reference to necktie sewing machines but the invention is not limited thereto.

DESCRIPTION OF THE RELATED ART

DE-U-8807418 may be of interest relative to the present invention.

In such sewing machines hitherto in use, there is an eye at the pointed end of a wire needle into which the sewing thread is threaded, after the empty needle has been pushed through a folded tie cut-out and the needle is then withdrawn through and out of the tie in the longitudinal direction. The needle is made of wire of an appropriate length because it has to be taken through the whole length of the tie cut-out. After each sewing operation, the sewing thread has to be threaded afresh in the needle eye, for which purpose considerable precision is necessary both to hold the point of the needle in the threading position and to guide the sewing thread through the needle eye.

According to DE-U-8807418, it has already been proposed to construct the point of the needle in the form of a hook in order to pick up a sewing thread automatically when withdrawing the needle. How this is to be done in detail is not disclosed.

SUMMARY OF THE INVENTION

It is the object of the invention to make the threading operation particularly favourable in such a sewing machine. According to the invention, there is provided an apparatus for threading a sewing thread into a needle having a hooked end, the apparatus including means to loop the sewing thread at least partially around the shank of the needle with the needle in an extended position, whereby, upon retraction of the needle, the sewing thread is engaged by the hooked end even if the hooked end should become twisted out of its normal orientation.

The invention also provides a method of threading a sewing thread into a needle having a hooked end, comprising the step of looping the thread at least partially around the shank of the needle with the needle in an extended position, whereby, upon retraction of the needle, the sewing thread is engaged by the hooked end, even if the hooked end should become twisted out of its normal orientation.

More particularly the invention provides an apparatus for threading a sewing thread in the needle of a necktie sewing machine which sews a longitudinal seam along the necktie using a wire needle wherein, in order to guide the sewing thread there is provided an eye which is in alignment with the trajectory of the point of the needle and arranged before the beginning of the longitudinal seam and to which and through which the sewing thread unwound from a supply reel extends to the necktie, and a gripper disposed in the region of the eye to grip the sewing thread at the side of the eye adjacent to the supply reel after a sewing operation has been carried out, wherein the gripper is movable in such a manner that the sewing thread gripped thereby wraps tightly, substantially in U- or V-shape, around the needle which has passed through the eye and which is constructed in the form of a hooked needle which, during its subsequent sewing movement, grasps the sewing thread with its hook and pulls it through the eye.

According to one embodiment of the invention, the gripper is carried by an arm pivotable about two mutually perpendicular axes to loop the thread at least partially around the shank of the needle when the needle has passed through the eye, so that, during the subsequent sewing movement, during which the needle is pulled back through the eye again, the sewing thread is reliably grasped by the needle hook regardless of whether the hook is turned to a greater or lesser extent in relation to the middle of the loop. A slight twisting of the needle is possible because of the construction of the needle from wire and because of its relatively great length, so that this must be taken into account for the purpose of reliable grasping of the sewing thread by the hook. According to the invention, this occurs automatically as a result of the looping of the threads around the needle.

In accordance with another embodiment, the movement of the gripper can be simplified in that, after gripping the sewing thread, the gripper pulls this transversely in front of the eye and associated with the gripper there is pusher e.g. in the form of a pivotable fork which, after the needle has been crossed by the sewing thread pulled tight by the gripper, is pivoted so that the tines of the fork engage the sewing thread and are moved past the point of the needle on either side thereof so as to loop the sewing thread over the needle, substantially in V- or U- shape.

Thus in this embodiment the movement of the gripper is supplemented by movement of the fork so that, by their combined movement, the substantially V- or U-shaped guiding of the sewing thread is realized, allowing for successful picking up of the thread by the needle hook even with substantial twisting of the needle, whilst simplifying the required movement of the gripper.

BRIEF DESCRIPTION OF THE DRAWINGS

Embodiments of the invention are illustrated by way of example in the drawings, to which the following description refers, and in which.

DETAILED DESCRIPTION OF THE PREFERRED EMBODIMENT

Figure 1:
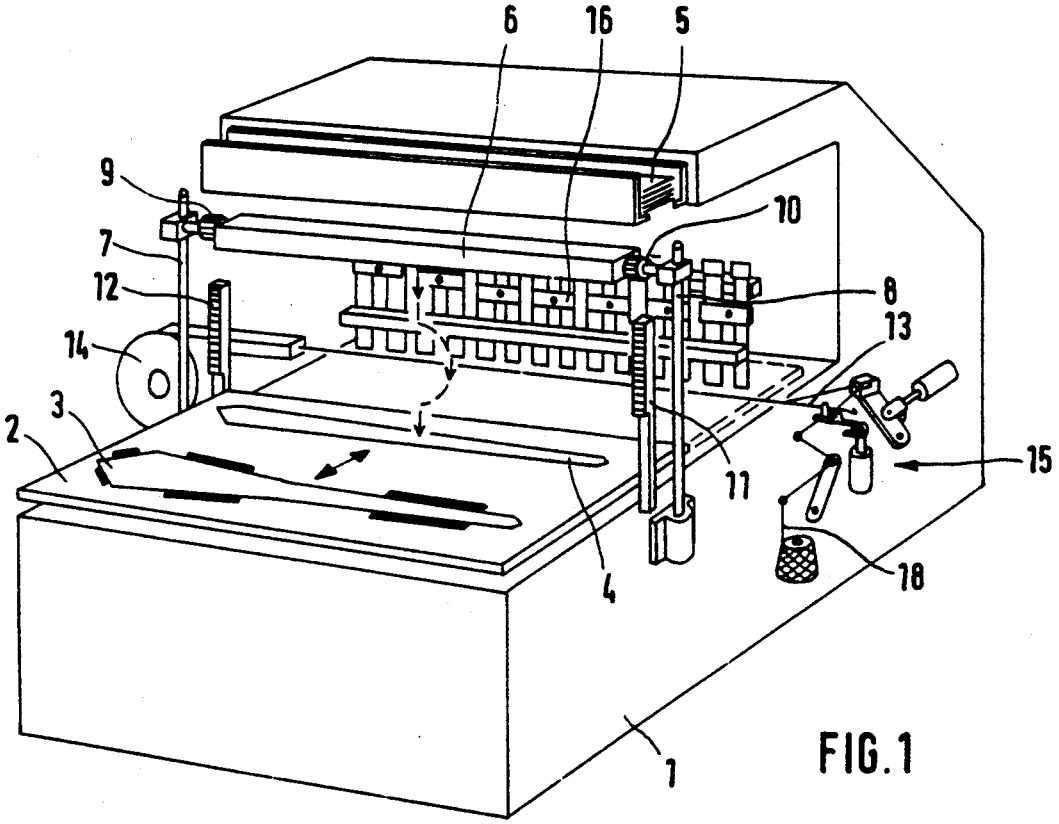
FIG. 1 shows a perspective view of a tie sewing machine with laterally attached apparatus for threading the sewing thread.

The tie sewing machine illustrated in FIG. 1 consists of a machine frame 1 on which a supporting table 2 is mounted for displacement as indicated by the double headed arrow.

A tie cut-out 3 and a tie stiffening 4 are laid on the supporting table 2. The tie cut-out 3 and the tie stiffening 4 are brought together by a displacement movement which is not material to the invention and are brought into the sewing position. Before the sewing operation, the tie cut-out 3 is folded by means of the folding sword 16 which is movable vertically up and down. Apparatus for folding the cut-out is described and claimed in our co-filed application entitled "Apparatus for Folding a Cut Tie in a Tie Folding Machine," U.S. patent application Ser. No. 07/573,238.

The tie stiffening 4 is taken from a stack 5 by a gripping mechanism 6 which qrasps the lowest layer of the stack 5 each time and deposits it on the supporting table 2, for which purpose the gripping mechanism 6 executes a rotary movement through 180° indicated in FIG. 1 by the broken line provided with arrow heads. This rotary movement comes about as a result of the fact that the gripping mechanism 6 is displaceably mounted on slide bars 7 and 8 and carries two pinions 9 and 10 which encounter two racks 11 and 12 during the downward movement of the gripping mechanism 6, as a result of which the gripping mechanism 6 executes the rotary movement through 180° during its further downward movement. The reverse sequence of movements occurs during the subsequent upward movement. Apparatus suitable for feeding the stiffening to the supporting table 2 is described and claimed in our co-filed application "Apparatus for Feeding a Tie Insert to the Feed Table of a Tie Sewing Machine," U.S. patent application Ser. No. 07/573,834.

The wire needle 13 consists of high-strength spring-steel wire which is wound on a needle drum 14 in the retracted position of the needle 13. For the threading of the sewing thread 18, the needle 13 is pushed out of the needle drum 14 and finally arrives with its point in the region of the threading apparatus 15, out of which it is withdrawn again in order to carry out the sewing operation, the wire of the needle 13 being wound on the needle drum 14. In the course of this, the needle 13 runs up a longitudinal seam, the position of which corresponds to the needle 13 shown in FIG. 1.

The sewing operation is effected in known manner in that during the advance of the needle 13 from the needle drum 14 to the threading apparatus 15, the needle 13 pierces through the material of tie cut-out 2 and tie stiffening 4, which material is held undulated, so that during the pulling back of the needle 13 with the sewing thread 18 threaded, the latter is pulled through the material in accordance with the undulating shape to sew the parts in question together. This is also a known operation.

In order to explain the form and operation of the threading apparatus, the embodiment illustrated in FIG. 2 will now be described.

Figure 2:
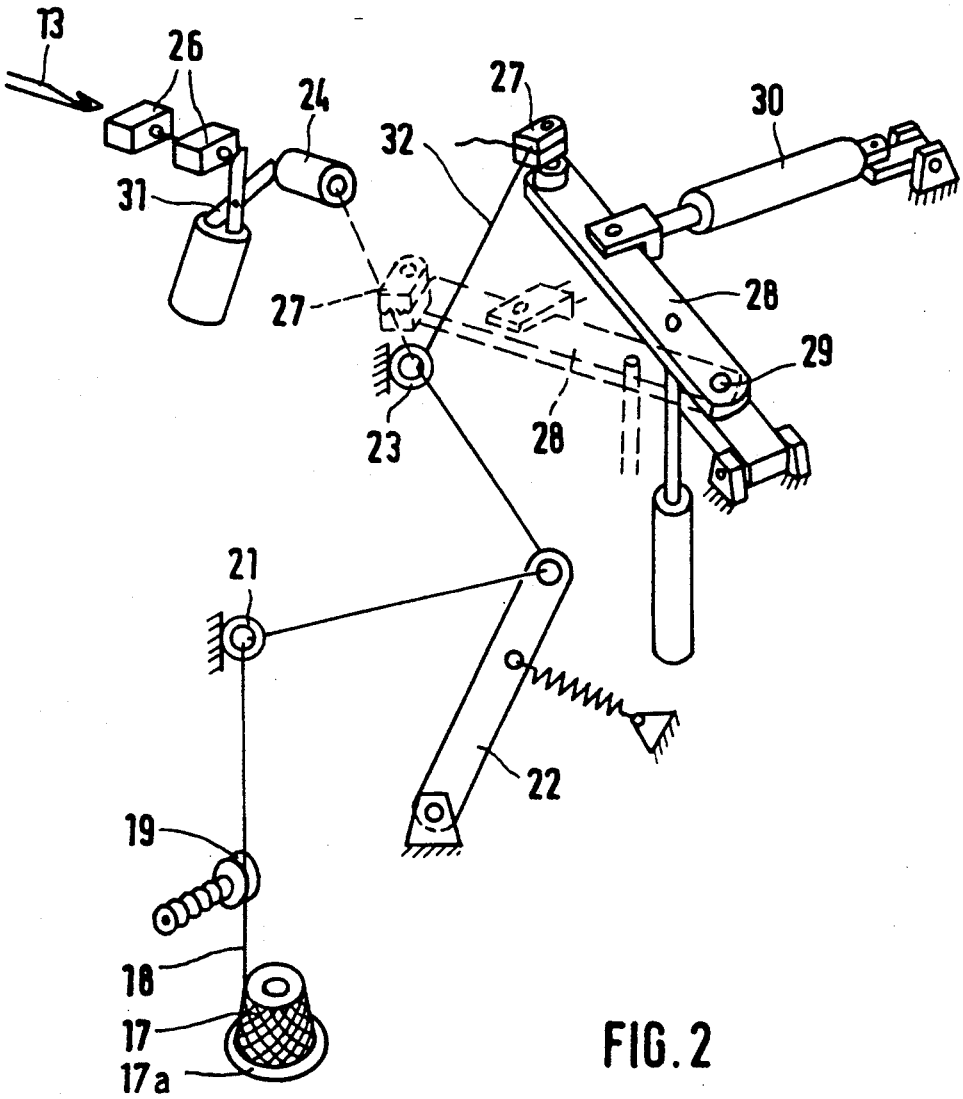
FIGS. 2 and 3 show a threading apparatus according to the invention in detail in two respective operating positions.

The embodiment of FIG. 2 includes a holder 17*a* for a supply reel 17 of sewing thread 18 which, while being unwound from the supply reel 17, passes through a thread brake 19, a guide ring 21, a tensioner 22, a guide ring 23 and, according to the continuation in broken line, enters the eye 24. During sewing the thread 18 is pulled over the path by means of the hooked needle 13.

Two needle guides 26 are also shown in FIG. 2, between the hooked needle 13 and the eye 24. At the end of the sewing operation (that is to say hooked needle 13 completely withdrawn), the sewing thread 18 assumes the position illustrated by the broken line between the guide ring 23 and the eye 24.

In this position of the sewing thread 18, the gripper 27 is swung into the position shown in broken lines. For this purpose, it is mounted on a swivel arm 28 which is pivotable about a pivot 29. The swivelling of the swivel arm 28 is effected by means of a piston-cylinder unit 30 articulated thereon. In the position of the gripper 27 drawn in broken lines, it grasps the thread 18 in the region between guide ring 23 and eye 24 whereupon the gripper 27 is swung into the position drawn by means of full lines, by corresponding swivelling of the swivel arm 28. Before this swivelling of the swivel arm 28, shears 31 are actuated which sever the sewing thread in the region between the eye 24 and the first thread guide 26. Thus the residue of the thread 28 which is in the eye 24 can be pulled out of the eye 24 during the swivelling of the gripper 27. During this swivelling a taut length of thread 32 is formed which extends transversely in front of the eye 24 from the guide ring 23 to the swivelled gripper 27.

The threading operation will now be described with reference to FIG. 3. First the hooked needle 13 is pushed forward through the material of the tie cut-out and of the tie stiffening, in the manner described above in connection with FIG. 1, until the hooked needle 13 assumes the position illustrated in broken lines in FIG. 3. As a result of the length of thread 32 being pulled tight transversely in front of the eye 24 and indeed somewhat above the longitudinal axis of the eye 24, the hooked needle 13 first passes through under the length of thread 32. Now, as a result of the actuation of a piston-cylinder unit 25, the swivel arm 28 is pulled down, namely into the position shown in broken lines in FIG. 3, and the gripper 27 accordingly takes the length of thread 32 with it and loops it partially round the shank of needle 13 (broken line). The needle 13 is thus wrapped about by the length of thread 32 substantially in the shape of a V or U. The movement of the swivel arm 28 previously described is rendered possible by a pivot bearing 40 which, together with the pivot 29, gives the swivel arm 28 a kind of universal-joint suspension in principle.

The hooked needle 13 is then withdrawn. In the course of this, it passes out of the position shown in broken lines in FIG. 3 through the position illustrated in full lines. In the course of this, the thread 32 laid in U- or V- shape round the hooked needle 13 slides into the hook 39 (see chain dotted line 32') and is thus carried through the eye 24 by the hooked needle 13, whereupon a continuous thread 18/32' is now pulled through the materials to be sewn together. During this, the two clamping jaws of the gripper 27 hold the thread 32 so that this is withdrawn from the supply reel 17 until shortly before the end of the sewing operation, when the gripper opens so that the end of the thread previously held by it is pulled into the tie cut-out.

At the end of this threading and sewing operation, the hooked needle 13 is in its retracted position whereupon the operations described in connection with FIG. 2 are repeated. The same operation of threading the thread 32 in the hook 39 of the hooked needle 13 then takes place in the same manner.

Figure 3:
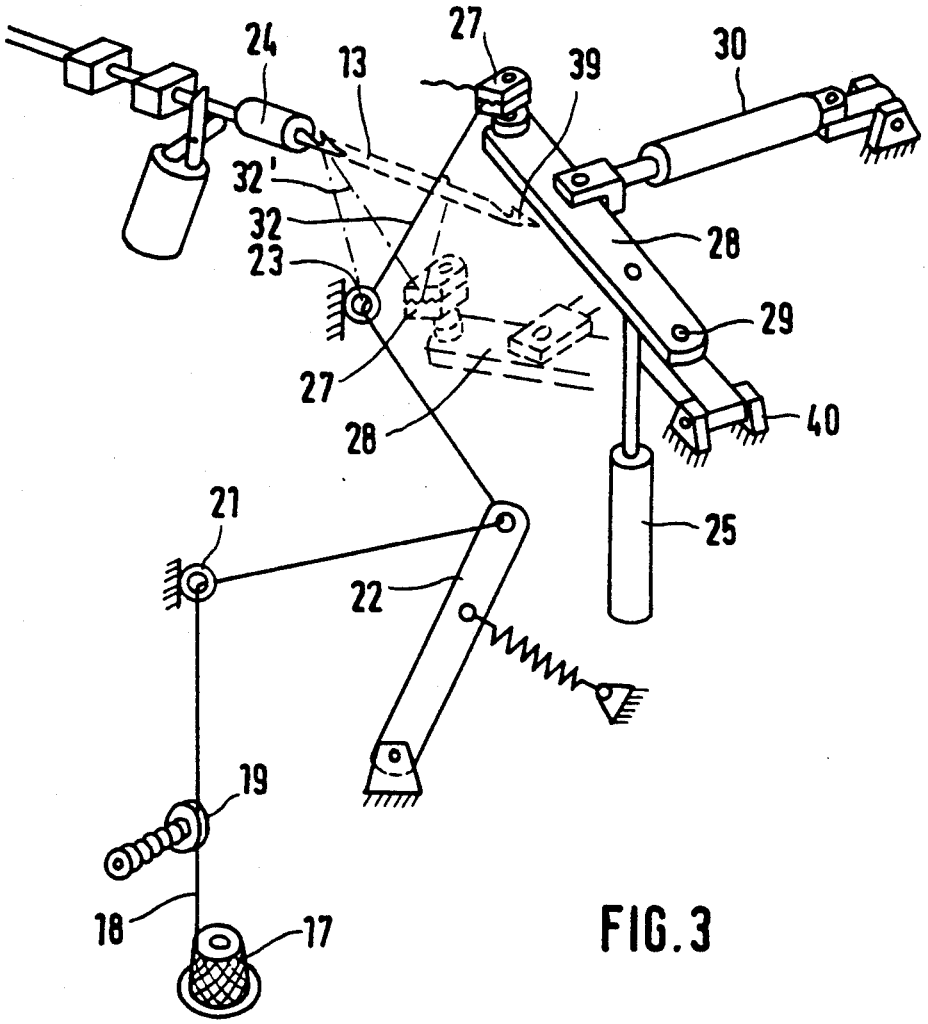

It can easily be seen from FIG. 3 that a slight twisting of the hooked needle 13 in relation to the centre of the substantially U- or V- shaped loop of the sewing thread 32 round the hooked needle 13 does not have an adverse effect on the correct grasping of the length of thread 32 by the hook 39 since the hook 39 can be turned through practically 45° to each side in relation to the centre of the loop and still grasps the length of thread 32 reliably even in such a twisted position. Such a severe twisting is not to be expected in practice, however.

Figure 4:
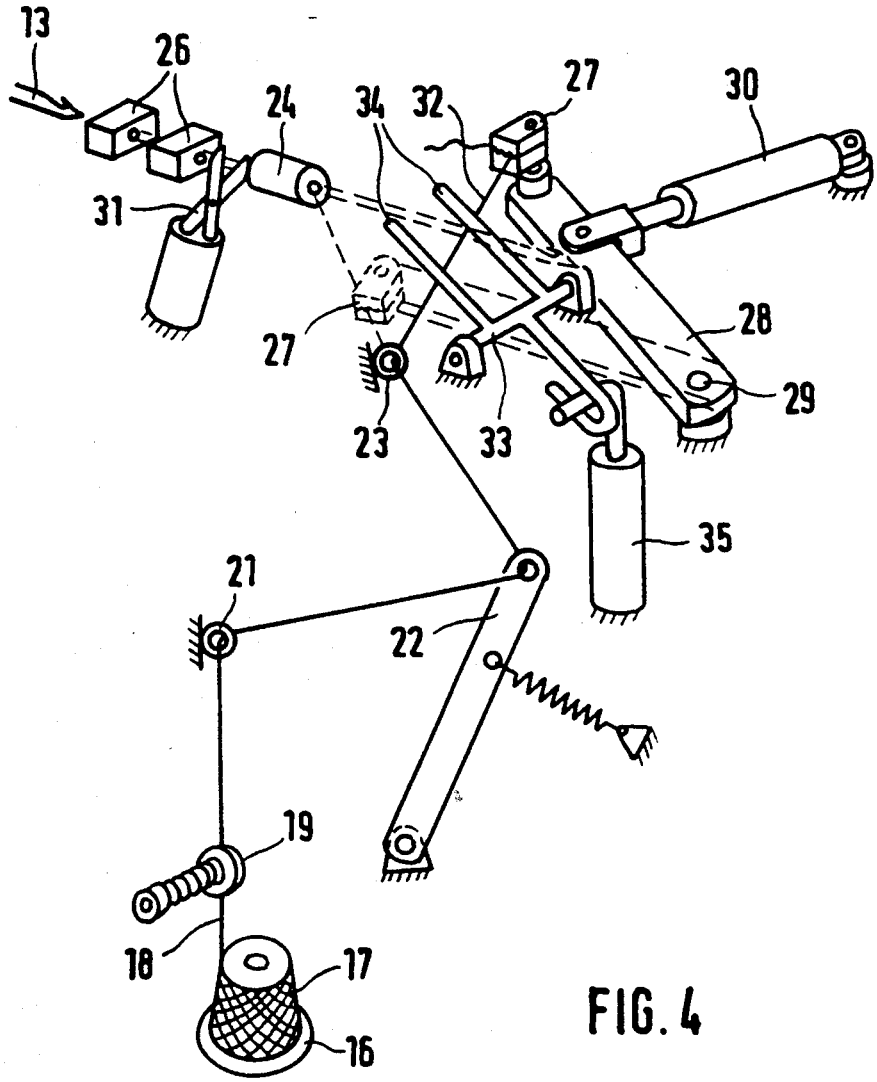
FIG. 4 shows a second embodiment having threading apparatus using a fork, the needle being shown withdrawn (during the sewing operation)
Figure 5:
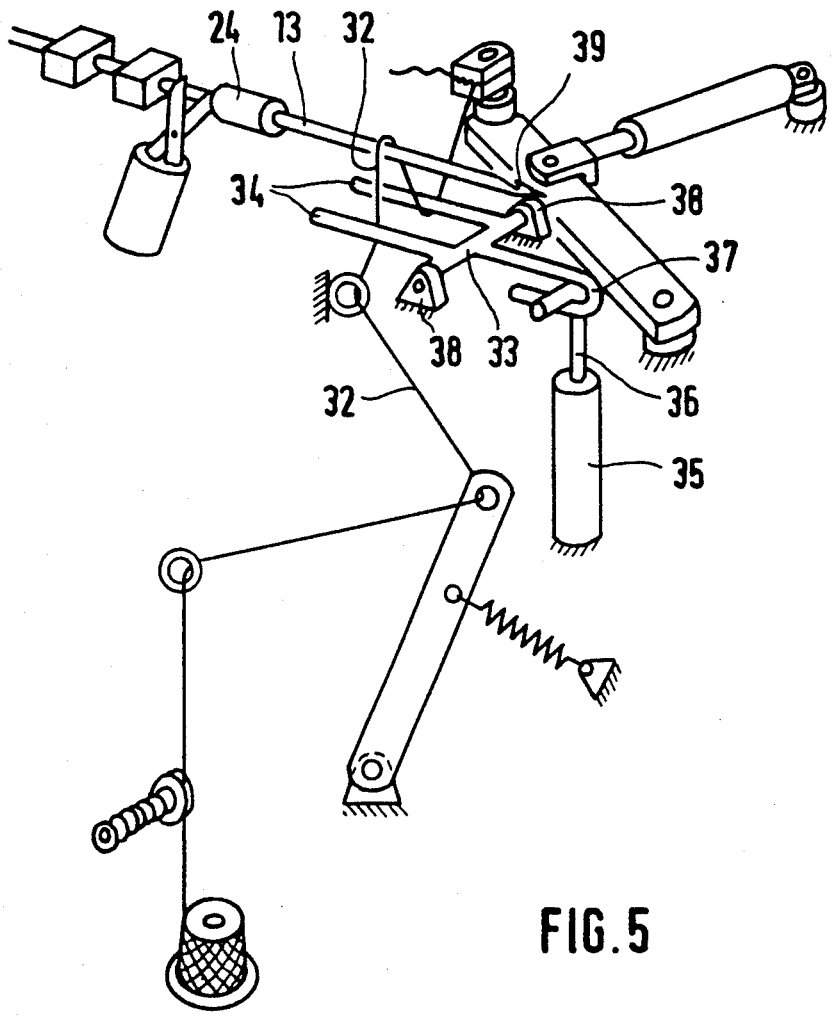
FIG. 5 shows the threading apparatus of FIG. 4 with the needle having passed through an eye and the fork swung down.

In FIGS. 4 and 5, a modification of the threading apparatus according to FIGS. 2 and 3 is illustrated. In the apparatus according to FIGS. 4 and 5, the movement of the gripper is simplified and supplemented by movement of a fork 33, as explained in detail below. FIG. 4 shows an operating position which corresponds to that in FIG. 2. The threading apparatus according to FIGS. 4 and 5 also contains many of the same components as the apparatus according to FIGS. 2 and 3 so that reference may be made to the description of FIGS. 2 and 3 for explanation of its arrangement and operation.

As in the apparatus according to FIG. 2, the gripper 27, in the position illustrated in broken lines, grasps the thread 18 in the region between ring 23 and eye 24, whereupon the gripper 27 is pivoted into the position drawn by means of full lines in which the length of thread 32 is pulled taut transversely in front of the eye 24. The needle 13 is then pushed forward into the position shown in broken lines in FIG. 4 in which the hooked needle 13 passes through under the length of thread 32. Now the fork 33 is pivoted downwards (FIG. 5) during which the two tines 34 move down laterally past the hooked needle 13 on either side thereof, and in the course of this movement press the length of thread 32 downwards so that this wraps round the hooked needle 13 practically in the shape of a U or V. The pivoting of the fork 33 is effected by means of the piston-cylinder unit 35, the push rod 36 of which engages in the rear end 37 of the fork 33 so that on appropriate movement for the push rod 36, the fork 33 is pivoted about its two pivot bearings 38.

The hooked needle 13 is now withdrawn. In the course of this, the thread 32 looped in V- or U- shape round the hooked needle 13 slides into the hook 39 and is thus carried through the eye 24 etc by the hooked needle 13 so that a continuous thread 32 is now pulled through the materials to be sewn together. During this, the two clamping jaws of the gripper 27 hold the thread fixed so that it is unwound from the supply reel 17.

At the end of this threading and sewing operation, the hooked needle 13 is in its retracted position whereupon the operations described in connection with FIG. 1 are repeated. The same operation of threading the thread 32 in the hook 39 of the hooked needle 13 then takes place afresh.

I claim:

1. An apparatus for threading a sewing thread onto a wire needle of a necktie sewing machine used in sewing a longitudinal seam along a necktie, comprising;

a supply reel for supplying sewing thread, said needle having a pointed end and an open hook adjacent said pointed end.

a thread guide positioned in alignment with a trajectory of said end of the needle and positioned at a location before that location where the longitudinal seam beings, a gripper for gripping the sewing thread at a location along the length of the thread between said eye and said supply reel said gripper and thread being movable in such a manner that when the sewing thread is gripped and moves, the thread wraps tightly around the needle in a substantially U or V shape, said open hook grasping the thread during movement of said needle and pulling the thread through said guide and effecting threading of said needle.

2. The apparatus according to claim 1, wherein said gripper pulls the sewing thread transversely in front of said guide and further including a pivotable fork associated with said gripper, said fork having tines which, after the sewing thread has been wrapped around the needle and pulled tight by the gripper, is pivoted so that said tines deflect the sewing thread onto opposite sides of said needle to form said thread U or V shape.

* * * * *

UNITED STATES PATENT AND TRADEMARK OFFICE

CERTIFICATE OF CORRECTION

PATENT NO. : 5,148,759

DATED : September 22, 1992

INVENTOR(S) : Rudi Wirth

It is certified that error appears in the above-identified patent and that said Letters Patent is hereby corrected as shown below:

Column 3, line 21, change "qrasps" to --grasps--.

Column 6, Claim 1, line 29, delete "eye" and substitute therefor --thread guide--.

Column 6, Claim 1, line 30, add a comma after "reel".

Signed and Sealed this

Seventh Day of September, 1993

Bruce Lehman

*Attest:*

BRUCE LEHMAN

*Attesting Officer*

*Commissioner of Patents and Trademarks*